US006502436B2

(12) United States Patent
Beatty

(10) Patent No.: US 6,502,436 B2
(45) Date of Patent: Jan. 7, 2003

(54) CYLINDRICAL SHELL FOR A DEADBOLT

(75) Inventor: Christopher Nathan Beatty, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 29 days.

(21) Appl. No.: 09/781,050

(22) Filed: Feb. 9, 2001

(65) Prior Publication Data

US 2002/0108408 A1 Aug. 15, 2002

(51) Int. Cl.[7] ..... E05B 65/06

(52) U.S. Cl. ..... 70/134; 70/370; 70/381; 70/DIG. 60; 70/451; 70/416

(58) Field of Search ..... 70/134, 416, 450, 70/451, 370, 466, 452, DIG. 43, DIG. 56, 372, 417, 418

(56) References Cited

U.S. PATENT DOCUMENTS 1,480,650 A * 1/1924 Bacon ..... 70/370
3,853,341 A * 12/1974 MacDonald ..... 292/171
3,961,508 A * 6/1976 Crepinsek ..... 70/370
4,338,804 A * 7/1982 Solovieff ..... 70/134
5,216,910 A * 6/1993 Lin ..... 70/370
5,249,444 A * 10/1993 Dancs ..... 70/380
5,540,070 A 7/1996 Adelmeyer
5,732,578 A * 3/1998 Kang ..... 70/224
5,761,937 A * 6/1998 Adelmeyer ..... 70/370
5,765,412 A * 6/1998 Koskela et al. ..... 70/134
5,816,086 A 10/1998 Russell
5,906,125 A * 5/1999 Shen ..... 70/370

* cited by examiner

*Primary Examiner*—Anthony Knight
*Assistant Examiner*—John B. Walsh
(74) *Attorney, Agent, or Firm*—Michael Best & Friedrich LLP

(57) ABSTRACT

The invention is directed to a device to protect a deadbolt assembly from tampering. A deadbolt assembly comprising a deadbolt reciprocable along a longitudinal axis, and a deadbolt actuating mechanism having an axis transverse to that of the deadbolt, is protected from intrusion and tampering by a pair of protective shells which encircle the actuating mechanism. The shells are generally cylindrical and of like structure and opposite orientation. Each shell comprises a ring and a circumferentially extending protective structure which extends axially toward the ring of the other shell. A preferred protective structure comprises a plurality of projections, including an arcuate tongue. A gap or opening in the protective structure permits actuation and movement of the deadbolt without interference with the shells.

10 Claims, 2 Drawing Sheets

CYLINDRICAL SHELL FOR A DEADBOLT

TECHNICAL FIELD

This invention relates to a deadbolt assembly comprising a deadbolt and deadbolt actuating mechanism for a door, and more particularly to an improved device of this type which includes structure to prevent tampering.

BACKGROUND OF THE INVENTION

Most door locks in current use are of one or the other of two types: the spring lock (or spring latch) or the deadbolt.

A spring lock is convenient to use. When one leaves a protected premises, such as a house, apartment, office or other protected building or suite, one sets the lock to the locked position and pulls the door shut on the way out. A spring-loaded latch engages a doorjamb and the door is locked. A major problem with spring locks is that they are relatively easily tampered with. This problem has long been recognized.

A deadbolt affords much greater security against unauthorized entry than a spring lock. It is less convenient, however. Typically, a key is required both to lock a door upon leaving and to unlock the door upon re-entry.

It is common practice to provide a door to a protected premises with both a spring lock and a deadbolt. These may be separate or may be combined into a single lock assembly.

A deadbolt installation in a door typically requires a recess in the door formed by a first bore (or cross bore) which extends from an outer face or surface of the door to an inner face or surface of the door and a second bore which intersects the first bore at right angles and extends to a door edge. A deadbolt reciprocates in this second bore. When extended, the deadbolt extends beyond the door edge to engage a doorjamb so that the door is locked. When retracted, the deadbolt is contained entirely within a cavity formed by the two bores. The deadbolt actuating mechanism is housed primarily within the first bore. The first bore is typically either 1 ½" or 2 ⅛" in diameter. A door recess of the same configuration and dimensions may be used for housing a combined spring latch and deadbolt lock assembly.

While a deadbolt is much more secure than a spring lock, it is not entirely immune to tampering. A primary purpose of the present invention is to afford greater protection against tampering than has been realized heretofore.

SUMMARY OF THE INVENTION

This invention provides a deadbolt assembly for a door in which the assembly comprises first and second housing members which are adapted to be disposed in proximity with an outside face and an inside face, respectively, of a door. A deadbolt is provided which is reciprocable between an extended (or latching) position and a retracted (or unlatching) position. A deadbolt actuating mechanism is disposed in a cavity in the door between the first and second housing members for reciprocating the deadbolt. This invention further comprises, as novel tamper-inhibiting members, a pair of oppositely oriented generally cylindrical shells surrounding the deadbolt actuating mechanism for preventing tampering with the mechanism. Each shell comprises a ring at a first end and a protective structure which extends axially in one direction from the ring. This direction is transverse to the direction of reciprocation of the deadbolt. The ring and the protective structure encircle the deadbolt actuating mechanism. The ring of each shell is in proximity with one housing member and the protective structure extends toward the other housing member. An opening in the protective structure permits linking of the deadbolt actuating mechanism so as to permit reciprocatory movement of the deadbolt without interfering with the shells, while inhibiting tampering with the deadbolt mechanism.

BRIEF DESCRIPTION OF THE DRAWINGS

This invention will now be described in greater detail with reference to the accompanying drawings.

In the drawings.

DESCRIPTION OF THE PREFERRED EMBODIMENTS

Figure 3:
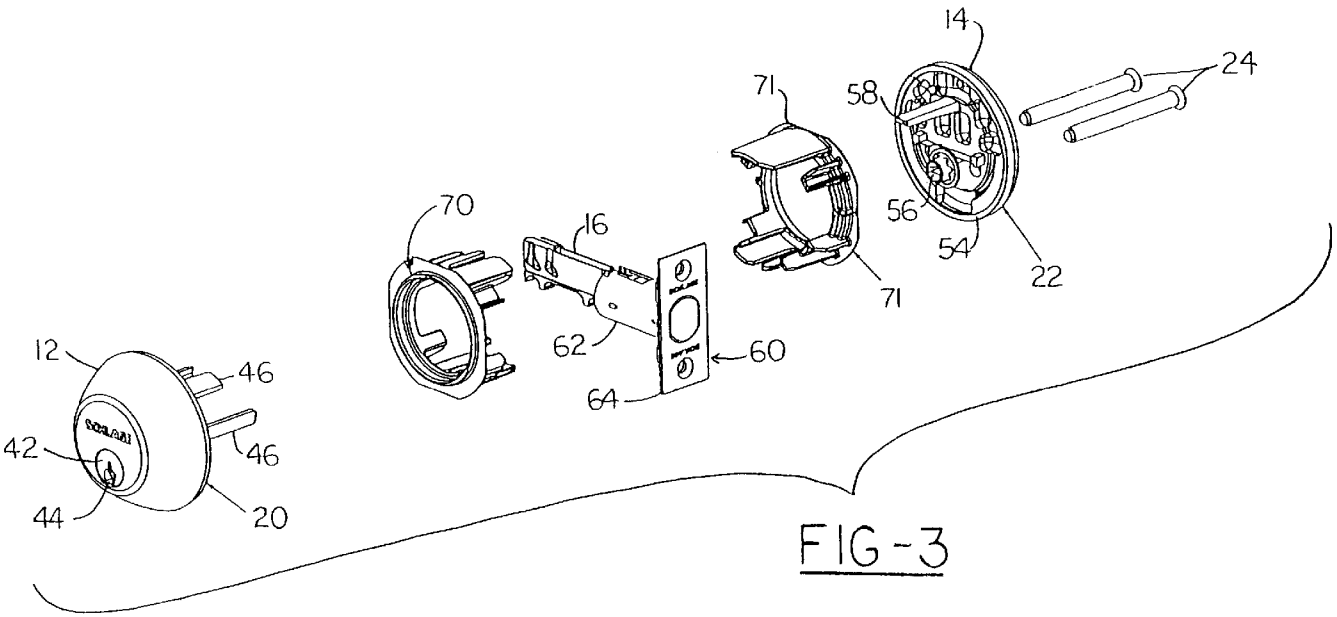
FIG. 3 is an exploded perspective view of the deadbolt assembly shown in FIG. 1.
Figure 2:
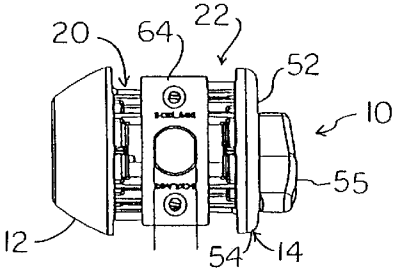
FIG. 2 is a side elevational view of the deadbolt assembly shown in FIG. 1.
Figure 6:
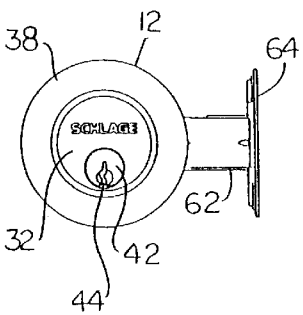
FIG. 6 is a front elevational view of the deadbolt assembly shown in FIG. 1.

This invention is applicable to virtually any deadbolt and actuating mechanism therefore. Accordingly, a deadbolt and actuating mechanism as described below may be known in the art, except as modified in order to receive the protective elements of this invention.

Referring to FIGS. 1–6, a deadbolt assembly 10 in accordance with this invention comprises an outside housing member 12, an inside housing member 14, a horizontally reciprocable deadbolt or latch 16, and a deadbolt actuating mechanism indicated generally at 18. The deadbolt actuating mechanism 18 comprises two sets of parts or components: a first set which is joined to the outside housing member to form an outside cylinder housing assembly 20, and a second set which is joined to the inside housing member 14 to form a thumbturn assembly (or inside housing assembly) 22. The outside cylinder housing member 12 and the inside housing member 14 may be circular in shape as seen in elevation, and are coaxial. The elements described so far are generally known in the art, except for modifications in the outside and inside housing members 12 and 14, respectively, which will be discussed hereinafter.

Deadbolt assembly 10 is held together by a pair of screws 24, which extend axially (i.e., parallel to the common axis of housing members 12 and 14).

Outside housing member 12 may be frustoconical and comprises a circular disk or plate 32 and a skirt 34 extending axially and rearward therefrom. Skirt 34 comprises an inner cylindrical portion 36 and an outwardly flaring frustoconical portion 38.

In addition to outside housing member 12, outside cylinder housing assembly 20 further comprises a first lock cylinder 42 extending rearwardly from plate 32 and having a keyhole 44 therein. A circular opening is provided in plate 32 to receive the lock cylinder 42.

Outside cylinder housing assembly 20 may further include a plurality of rearwardly extending tongues 46, which engage inside housing member 14 to allow for alignment during installation and easy attachment.

Inside housing member 14 comprises a circular plate 52 which may have a rounded peripheral portion, and a flange 54 extending inwardly (or rearwardly) therefrom. The inside housing member 14 forms part of the thumbturn assembly 22. Thumbturn assembly 22 further comprises a rotatable hand-operated lever 55 on the exterior of the inside housing member 14, and a second lock cylinder 56 which is keyed to the hand lever 55 so that the two rotate together. Second lock cylinder 56 is coaxial with and joined to first lock cylinder 42, which forms part of outside cylinder housing assembly 20. The two lock cylinders rotate together in one direction to extend the deadbolt 16, and in a second (and opposite) direction to retract the deadbolt 16. Thus, a door on which the present invention is installed can be either opened or locked shut from the outside with a key, or from the inside without a key and using lever 55.

Thumbturn assembly 22 may further include a tongue 58 which extends inwardly and engages the outside cylinder assembly 20 for alignment.

Deadbolt 16 forms part of a latch assembly 60 which further includes a cylindrical latch housing 62 surrounding a portion of the deadbolt, and a face plate 64, which may be attached (e.g., with screws) to the edge of a door.

Deadbolt 16 and cylindrical latch housing have a common longitudinal axis, which is transverse and preferably perpendicular to the common axis of outside housing member 12 and inside housing member 14. Deadbolt 16 reciprocates along this longitudinal axis between an extended or latching position and a retracted or unlocked position.

The structure described so far is generally known in the art. One example of this structure is shown in U.S. Pat. No. 5,540,070, which is hereby incorporated by reference.

According to the present invention, a pair of protective elements, which are generally cylindrical shells (or cylinder shells) 70 and 71 are provided to protect deadbolt 16 and deadbolt actuating mechanism 18 from tampering.

Figure 7:
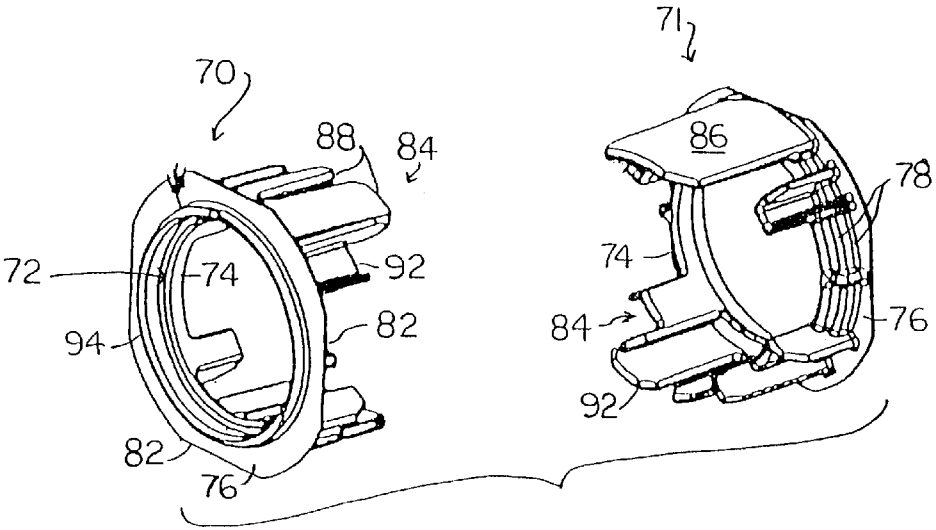
FIG. 7 is a perspective view, on an enlarged scale, of the cylindrical shells of this invention.
Figure 4:
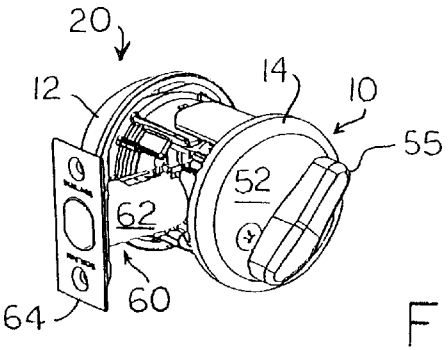
FIG. 4 is a perspective view of the deadbolt assembly of FIG. 1 as seen from a vantage point on the interior side thereof.

Referring now especially to FIG. 7, cylinder shells 70 and 71 may be formed to be identical, simplifying manufacture and use of the shells 70 and 71. As installed, they are oppositely oriented and concentric with outside housing member 12 and inside housing member 14. They are preferably installed 180° out of phase with each other.

Each of the cylinder shells 70 and 71 comprises a ring 72 at a first end, and a circumferentially extending protective structure which extends axially in one direction from the first end. The rings 72 of shells 70 and 71 are located in proximity with respective housing members 12 and 14. The protective structure of each shell extends axially toward the remote housing member (14 or 12) and the ring 72 of the other shell. The rings 72 and protective structures of each shell 70 and 71 encircle and surround the deadbolt actuating mechanism 18 to protect the deadbolt 16 and actuating mechanism from tampering.

Ring 72 of each cylinder shell 70 and 71 includes a cylindrical or tubular portion 74 of circular cross-section and short axial length and a flange 76 extending radially outwardly from one end of the tubular position (the end closest to the adjacent housing member 12 or 14). The tubular portion 74 extends inwardly (i.e., toward the other cylinder shell) from the flange 76. The tubular portion 74 may have a plurality of circumferential ribs 78 (4 are shown) on its inside surface. The ribs 78 provide additional structural integrity and facilitate against tampering when the shells 70 and 71 are installed. The flange 76 may have four cutoff portions, formed by straight line cut-outs 82, between two spaced points on the outer circumference of the flange, at equally spaced (90°) intervals, to facilitate positioning in the deadbolt assembly.

The shells 70 and 71 together form a protective structure, which in the preferred form shown in detail in FIG. 7 comprise a plurality of projections 84 which extend axially from the ring 72 (or first end) of each shell 70, 71 toward the ring 72 of the other shell 71, 70. These projections 84 include an arcuate tongue 86, one or more additional tongues 88, and one or more receptacles 92 for receiving tongues 88 to prevent relative rotation of the two shells 70, 71. Each receptacle 92 may be a three-sided structure comprising a circumferentially extending side flanked by two narrow radially extending sides, which serve as guides for a tongue 88.

A circumferentially extending opening or gap in projections 84, in the portion of the circumference of each shell 70 and 71 which is closest to deadbolt 16, permits linkage of the deadbolt 16 and actuating mechanism 18 so that the deadbolt 16 can be reciprocated without interference with shells 70 and 71.

Figure 1:
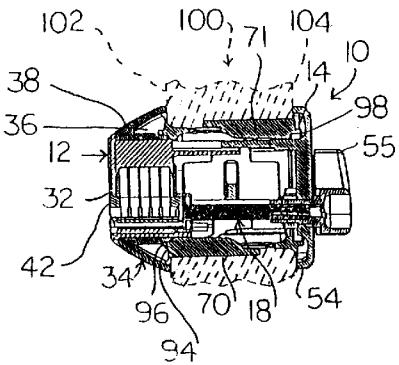
FIG. 1 is a vertical sectional view of a deadbolt assembly according to this invention.

As seen in FIG. 7, each cylinder shell 70, 71 also has an outwardly extending circular lip 94. Each lip 94 extends in a second direction toward an adjacent housing member. As shown in FIG. 1, the lip 94 of the first cylinder shell 70 is received in a recess 96 formed on an inner side of the outside housing member 12. The lip 94 of the second cylinder shell 71 is received in a recess 98 on the inner side of inside housing member 14. The lips 94 on the cylinder shells 70, 71 and the mating recesses 96, 98 on the housing members 12, 14 aid in seating the cylinder shells 70 and 71 in a desired orientation such that the cylinder shells have a common axis, which is transverse to and preferably perpendicular to the longitudinal axis of deadbolt 16. It will be appreciated that the aforementioned recesses 96, 98 are provided in accordance with this invention, but that otherwise the structures of the housing members 12 and 14 may be as known in the art.

Figure 8:
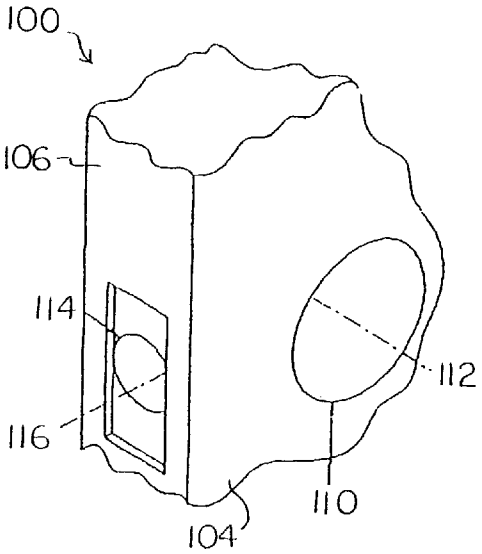
FIG. 8 is a perspective view of a door which has been bored in a conventional manner to create a cavity for receiving a deadbolt assembly according to this invention.
Figure 5:
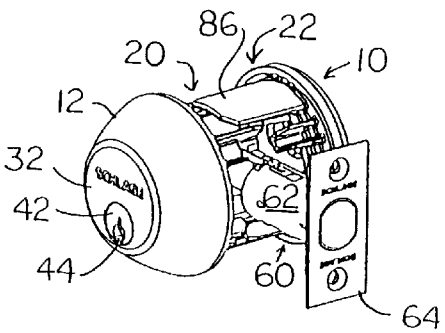
FIG. 5 is a perspective view of the deadbolt assembly of FIG. 1 as seen from a vantage point on the exterior side thereof.

The deadbolt assembly 10 may be installed in a door 100, shown in FIG. 8. Door 100 comprises an outside face 102 (see FIG. 1) and an inside face 104 (FIGS. 1 and 8) which are spaced from and parallel to each other. Connecting the outside face 102 and the inside face 104 is a door edge 106. Outside face 102, inside face 104 and edge 106 are all substantially vertical.

A cavity is formed in door 100 to receive the deadbolt assembly 10. This cavity is formed by two intersecting cylindrical bores, namely, a first bore (or cross bore) 110, and a second bore (or latch bore) 114. The first bore 110 extends from the outside face 102 to the inside face 104 of door 100, and has an axis 112 which is perpendicular to faces 102 and 104. The second bore 114 extends from the first bore 110 to the door edge 106. The second bore 114 has an axis 116 which is perpendicular to the axes of the first bore 110 and to the door edge 106. The door 100 and the bore configuration may be conventional.

The thickness of door 100 and the diameters of cross bore 110 and latch bore 112 may vary as known in the art. Common cross bore diameters in the United States are 1 ½ inch and 2 ⅛ inch.

A deadbolt assembly 10 as described herein can be designed to be installed in door preparations of different sizes, such as 1 ½ inch diameter and 2 ⅛ inch diameter. The shells 70 and 71 are designed to fit in these or other size door preparations without structural modification or change in the size of any of the parts.

To create a deadbolt installation in accordance with this invention, one first inserts cylinder shells 70 and 71 into the cross bore 110 of a door 100. The shells 70, 71 are identical parts such that they can be indexed to be telescoping to cover a broad door range from 1 ⅜ inch to 2 ¼ inches. The outside cylinder assembly 20 and the inside turn assembly (or thumbturn assembly) 22 are aligned and inserted into cross bore 110 so that their inwardly extending components are disposed inside the protective cylinder shells 70 and 71. As the outside housing assembly 20 and the inside turn assembly 22 are moved toward each other, the first and second lock cylinders 42 and 56, respectively, are brought together in driving relationship with each other and with the deadbolt latch assembly 60. The shells 70 and 71 are designed to mate with these components, such that the lips 94 fit into recesses 96 and 98 respectively, while still engaging one another. In the preferred embodiment, the shells 70 and 71 are designed to provide a minimal internal clearance between the outside cylinder housing assembly 20 and the shells 70 and 71. The interlocking relationship of the shells 70 and 71 with the outer housing 20 and inner housing 14, provides a unified structure which resists tampering. The unified structure will effectively act as a single component to resist vertical impact imposed on the outside cylinder housing 20. The shells 70 and 71 also self-center the assembly on a door, with the interlocking shells and lips 94 facilitating centering of the deadbolt on a door to simplify installation thereof.

The particular cylinder shell structure illustrated herein, represents the best mode and preferred embodiment. However, variations and modifications are possible without departing from the scope of this invention. More broadly, other shell structures which afford increased protection against intrusion and tampering while permitting the deadbolt to be extended and retracted laterally relative to the axis of the shells without interference, are within the scope of this invention. In other words, the configuration of the projections may differ from that shown herein as long as such configuration meets the above criteria. It is not necessary for the two shells to be structurally identical, or that the shells telescope with one another to accommodate different size door preparations.

Numerous deadbolt and deadbolt actuating system structures are known in the art, and in general can be protected in accordance with this invention. In general, any deadbolt and deadbolt actuating system assembly which can be installed in a door preparation as shown in FIG. 8, can be protected in accordance with this invention. Combined deadbolt and spring-operated latch bold systems can also be protected by cylinder shells in accordance with this invention.

The present invention also offers increased protection from tampering and intrusion. In particular, the shells 70 and 71 herein thwart an intruder who would attempt to manipulate the actuating mechanism and move the deadbolt by "tunneling in" alongside the mechanism from the exterior face of the door. The shells 70 and 71 act as a pick shield to the deadbolt latch. The interlocking tangs receiving recesses of the shells 70 and 71 surround the latch bolt mechanism with openings only for the sliding action of the latch bolt. Without the protective shells of this invention, it is possible for an intruder to gain access to the actuating mechanism so as to move the deadbolt (or dead latch) to the retracted position. Also, with the protective shells of this invention in place, the deadbolt assembly shown and described herein will pass the Grade 1 vertical impact testing requirements.

While this invention has been described with particular reference to the best mode and preferred embodiment thereof, variations and modifications can be made without departing from the scope and spirit of this invention.

What is claimed is:

1. A deadbolt assembly for a door, said door having an inside face and an outside face, the deadbolt assembly comprising:

first and second housing members adapted to be disposed in proximity with said outside face and said inside face, respectfully;

a deadbolt which is reciprocable between an extended position and a retracted position, said deadbolt in said extended position extending past an edge of said door to prevent opening of said door, said deadbolt in said retracted position being disposed wholly within said door;

a first shell including a first circumferentially extending flange, a first axially extending lip, and a first plurality of axially extending projections, said first axially extending lip extending into said first housing member, said first flange engaging an outer face of said first housing member; and a second shell including a first circumferentially extending flange, a second axially extending lip, and a second plurality of axially extending projections, said second axially extending lip extending into said second housing member, said second flange engaging an outer face of said second housing member, said first and second shells being oppositely oriented and surrounding said deadbolt actuating mechanism.

2. A deadbolt assembly according to claim 1, wherein said first and second shells are coaxial.

3. A deadbolt assembly according to claim 2 wherein said first and second shells and said first and second housing members have a common axis which is transverse to the direction of movement of the deadbolt.

4. A deadbolt assembly according to claim 2 wherein said first and second shells are of like structure.

5. A deadbolt assembly according to claim 4 wherein said first plurality of projections and said second plurality of projections are disposed as to leave a clear space along a longitudinal axis of said deadbolt.

6. A deadbolt assembly according to claim 5 wherein said first plurality of projections includes a first arcuate tongue and a receptacle, said second plurality of projections includes a second arcuate tongue and a second receptacle, said first receptacle receiving said second tongue and said second receptacle receiving said first tongue.

7. A deadbolt assembly according to claim 1 wherein said shells are arranged in telescoping relationship.

8. A deadbolt assembly according to claim 1 wherein said first shell includes a first ring and said second shell includes a second ring, said first ring and said second ring encircling said deadbolt actuating mechanism.

9. A deadbolt assembly according to claim 1 wherein said first lip matingly engages a first recess defined by said first housing member, said second lip matingly engages a second recess defined by said second housing.

10. A deadbolt assembly for a door comprising:

(a) first and second housing members adapted to be disposed in proximity with an outside face and an inside face, respectively of a door each one of said first and second housing members defining a recess;

(b) a deadbolt which is reciprocable between an extended position and a retracted position, the deadbolt in said extended position extending past an edge of said door to prevent opening of the door, the deadbolt in said retracted position being disposed wholly within said door;

(c) a deadbolt actuating mechanism disposed between said first and second housing members for reciprocating said deadbolt; and (d) first and second oppositely oriented generally cylindrical shells surrounding said deadbolt actuating mechanism to prevent tampering with said mechanism, each of said shells having a circumferentially extending first end which encircles the deadbolt actuating mechanism and is in proximity with one of said housing members, and a protective structure extending axially toward the other housing members, the direction in which said protective structure extends being transverse to the direction of movement of said deadbolt, the configuration of said protective structure being such as to afford an opening to permit linking of said deadbolt and said deadbolt actuating mechanism so as to permit movement of the deadbolt without interference while tampering with the deadbolt actuating mechanism each of said shells having a lip extending axially from said first end, and said lips being received in recesses defined by said first and second housings, respectively.

* * * * *